United States Patent [19]

Curzons

[11] 4,310,332

[45] Jan. 12, 1982

[54] OXIDATION OF SULFUR DYES

[75] Inventor: Philip B. Curzons, Altrincham, England

[73] Assignee: Interox Chemicals Limited, London, England

[21] Appl. No.: 225,521

[22] Filed: Jan. 16, 1981

[30] Foreign Application Priority Data

Feb. 7, 1980 [GB] United Kingdom ..... 04164/80

[51] Int. Cl.[3] ..... D06P 1/30

[52] U.S. Cl. ..... 8/652; 8/650

[58] Field of Search ..... 8/652, 650

[56] References Cited

U.S. PATENT DOCUMENTS 3,278,254 10/1966 Chadwick ..... 8/652

4,036,586 7/1977 Rowe ..... 8/652

FOREIGN PATENT DOCUMENTS 2526778 1/1977 Fed. Rep. of Germany ..... 8/652

49-126983 12/1974 Japan ..... 8/652

*Primary Examiner*—Maria Parrish Tungol

*Attorney, Agent, or Firm*—Larson and Taylor

[57] ABSTRACT

The present invention relates to a process for the oxidation of sulphur dyes, particularly when they are incorporated in natural or regenerated cellulose textile fibres such as cotton, which employs an alternative oxidant to the ecologically undesirable dichromate now used. The process employs two steps, in the first of which the sulphur dyed textile is contacted with dilute hydrogen peroxide, very conveniently having a pH of 3–5 and at a temperature of from 40–80° C. and in the second step, the textile is then contacted with a dilute solution of activator often ferric sulphate, preferably at pH 3–4 and from 0.1 to 1.0 g/l activator concentration. The process can be effected with relatively minor alteration or addition to existing equipment.

12 Claims, No Drawings

OXIDATION OF SULFUR DYES

The present invention relates to a process for the oxidation of sulphur dyes, more particularly when the same have been employed to dye natural or regenerated cellulose textile fibres.

Sulphur dyes have been employed on a considerable scale for many years to dye natural and regenerated cellulose textile fibres, and in particular cotton and rayon and mixed fibres containing them in substantial proportions, especially for work wear and leisure wear. In conventional processes for their application, sulphur dyestuffs are taken up by the cellulose fibre in the reduced form and are thereafter oxidised in situ to render the dye colourfast.

Herein, the term "sulphur dyes" is used in the conventional manner i.e. indicates those dye stuffs having as a common feature the presence of sulphide or particularly polysulphide groups, often produced by thionisation, which are supplied to fibre in the reduced state and thereafter oxidised in situ. It will be recognised that the chemical structure for many of these dyes is not fully known.

In conventional processes, oxidation of the sulphur dyes is effected with an aqueous solution of sodium or potassium dichromate, because the resultant oxidised dye exhibits good colour fastness and very little tendency to be redeposited on other fabrics which are being washed with the dyed fabric in the same tub. However, the use of sodium or potassium dichromate results in a product having a harsh handle, an undesirable product characteristic, but, more importantly, the large volumes of chromium-containing effluent pose ecological problems in view of the toxicity of chromium and the difficulty of removing it to a sufficient extent from the effluents. The industry itself has recognised that it needs to replace alkali metal dichromate by some alternative oxidant, but as yet no universally acceptable alternative has emerged.

One of the alternatives to alkali metal dichromate that has been proposed in the past is oxidation with hydrogen peroxide. Its use has the advantage of imparting to the fibres a softer handle, and the ecological advantage that its decomposition products are water and oxygen, but its performance in oxidising, especially the more difficult to oxidise dyes such as the sulphur red/brown is not satisfactory in that there is insufficient reproducibility of the colour and a tendency for staining, i.e. redeposition of the dye from the dyed fabric onto other fabrics with which it is being washed. These disadvantages remain even when a weak acid such as acetic acid is employed in the oxidation bath in conjunction with the hydrogen peroxide.

A one bath copper catalysed hydrogen peroxide oxidation process has been described in U.S. Pat. No. 4,036,586, but copper is not really an effective decomposition catalyst for hydrogen peroxide, but also is strongly retained by dye impregnated cellulose fabrics so that there are inherent practical difficulties in providing a stable one bath system that yields reproducible results.

It is an object of the present invention to provide a process employing hydrogen peroxide as oxidant but which reduces or avoids the aforementioned disadvantages.

According to the present invention there is provided a process for the oxidation of sulphur dyes in reduced form, impregnated in or on a natural or regenerated cellulose fibre, comprising the step of first contacting the impregnated fibre with a dilute aqueous solution of hydrogen peroxide in order to effect at least partial oxidation of the sulphur dye and thereafter contacting the fibre containing a residual amount of the aqueous hydrogen peroxide solution with a solution of a transition metal activator for hydrogen peroxide.

The first step in the oxidation process, namely that in which the fibre is contacted and impregnated with hydrogen peroxide solution is generally effected at a temperature in the range of 40°–80° C. This gives optimum rate of oxidation and also prevents excessive wasteful decomposition of the hydrogen peroxide. A residence time of only a few seconds of dye-impregnated fibre in the hydrogen peroxide impregnation bath can produce acceptable results in the two stage method envisaged by the present invention, but longer residence times of a minute or longer can also be tolerated, so that the present process is well suited to continuous processes over a wide range of speeds of movement of the fibre normally in the form of cloth or yarn, and a wide variation in the size of the impregnation bath. Additionally, it will be recognised that this also enables the process to be employed in batch processes. In practice, for a continuous process, the residence time is dictated by the apparatus employed and any residence time within the range of 3 to 60 seconds can be used. It will be recognised that when the cloth or yarn leaves the impregnation bath it will carry with it a residual amount of solution, the actual amount being determined by the extent to which the cloth or yarn is squeezed or pressed, usually by a pair of rollers having an adjustable nip between them and that reaction between hydrogen peroxide and the sulphur dye can continue during this period also. In practice, at normal speeds of cloth or fibre employed conventionally, such additional reaction time is relatively short, often being less than a second.

The concentration of hydrogen peroxide in the impregnation bath solution in general need not be greater than 1%. A concentration in excess of 1% is not recommended, in that it can result in excessive carry-over of peroxide into the second step bath and result in the wasteful decomposition of excess hydrogen peroxide. Preferably the concentration of hydrogen peroxide in the bath is at least 0.1%, and especially in the range of 0.1 to 0.5% by weight. The concentration in the bath can be maintained during operation of the process by continuous or intermittent monitoring, and the introduction as a result as necessary of higher concentration hydrogen peroxide. Advantageously, such hydrogen peroxide can be standard commercially available hydrogen peroxide, e.g. having a concentration of 30–50% by weight and containing low concentrations of sodium pyrophosphate and sodium stannate. There is therefore no need to incorporate large quantities of highly expensive stabilisers such as organic phosphonates, although they can be incorporated without disadvantage if desired. The pH of the bath can be adjusted by addition of an appropriate amount of an acid, such as acetic acid or an alkali such as sodium carbonate, although it is highly desirable to maintain the bath at an acid pH, and particularly a pH of up to 5.5. In practice, the solution after has a pH of at least 1.0, preferably, from pH 3 to pH 5. Conveniently, diluted hydrogen peroxide solution. Having such a preferred pH can often be obtained by dilution of standard hydrogen peroxide with the local water supply.

In the second step of the process according to the present invention, the hydrogen peroxide treated cellulose fibre or cloth is then contacted with a dilute solution of a transition metal activator for hydrogen peroxide. A concentration of activator in excess of 2 g/l can be employed if desired, for example in the range of 2 to 10 g/l, but in general it is not necessary to employ such high concentrations in that similar or improved results can be obtained employing lower concentrations of activator in this step. In order to obtain a desired level of fastness on washing, as evidenced by lack of redeposition of dye on fabrics washed therewith, it is desirable to employ a concentration of at least 0.05 g/l activator, but a concentration in the range of 0.005 to 0.05 g/l activator could be used provided the slightly impaired performance could be tolerated, for example in the dying of work wear such as overalls and jeans which are often washed separately from other garments and household textiles. Preferably, the concentration of activator is within the range of 0.05 to 2 g/l activator and particularly from 0.1 g/l activator, frequently up to 1.0 g/l activator.

As a result of the fact that the variation in dye fastness is relatively small in comparison with the changes in concentration of the activator, particularly in the range of 0.1 to 2 g/l, one convenient method of operating the second stage is to employ initially in the second stage bath a relatively high concentration of activator, for example in the range of 0.5 to 1.5 g/l followed by progressive dilution of the solution as activator is carried out of the bath in the yarn or cloth and the concentration of activator is restored to its original level, approximately, at intervals such as each day or when a predetermined lower limit is reached, for example 0.1 g/l.

It will be recognised that by employing the preferred concentrations of activator, the residual concentration of activator in the effluent is considerably lower than the concentration of chromium in its effluent, and in many cases smaller by a factor of 10 to 50. Thus, a problem of relatively high concentration of transition metal ions in the effluent can be significantly reduced by employment of the two step method of the present invention. Additionally and very importantly, the present method enables a transition metal of low or negligible toxicity such as iron to be employed instead of chromium which is acknowledged to have a relatively high toxicity. Moreover the techniques for removing low concentrations of iron from aqueous solution are in themselves well known so that at least in some embodiments, the present invention provides a process that is both practical to operate and substantially overcomes the harmful ecological problems recognised in respect of the standard dichromate method. The activator solution can be any iron compound sufficiently water soluble at the operating temperature to yield the desired concentration of iron. Particularly convenient sources include ferric and ferrous sulphate. It will be recognised though, that soluble iron salts represent the most highly preferred activators. A major advantage in their use in a process according to the present invention arises from the lower concentrations of transition metals employed in the two step process of the present invention. It is particularly desirable to maintain the iron activator solution at a pH below that at which brown stains, believed to be iron salts, precipitate out onto the cloth or yarn. A convenient pH is in the range of 3 to 4, although a lower pH could be used if desired.

The second step can be carried out at a temperature of from ambient up to approximately 80° C., preferably between 40° and 80° C. It is convenient to employ a temperature for step two that is the same as, or nearly that used in the first step of the oxidation process. The residence time of the cloth or yarn in the activator bath can be varied from a very short period of a few seconds through to a period in excess of a minute, if desired, without any significant change in the quality of the product being detectable.

It will be recognised that a two step oxidation process represents one step more than that employed in the conventional processes employed heretofore and for many continuous processes, there is insufficient space to permit the installation of an extra full size bath. Advantageously, the fact that very short residence times can be employed in steps 1 and 2 of the present invention process means that the two step process can be accommodated with relatively little disruption to the equipment.

In one method where the equipment permits, the standard oxidant impregnation tank can be divided in two, providing two tanks, the cloth or yarn passing from one tank to the other over conventionally used rollers and having in each of the two smaller tanks a residence time that is approximately half that in the undivided bath. Alternatively, advantage can be taken of the very short residence time needed for the second step by employing a very small bath located above and between the hydrogen peroxide impregnation tank and a subsequent cloth or yarn washing tank. Employing a conventional roller system and the small bath, the residence time of cloth or yarn in the second step or activation bath can be arranged to fall within the range from 3 to 20 seconds and in many cases 3 to 10 seconds, from which it can be seen that the additional bath to be employed is much smaller and lighter than the conventional bath. In order to minimise the concentration of transition metal salt in the effluent, the cloth or yarn issuing from the activator bath can be pressed or squeezed, preferably to the lowest liquor retention possible, preferably below 75% and in practice often from 55–60% based on the dry yarn or cloth, employing standard techniques and apparatus.

It will be recognised that one practical combination of residence times for the two steps and liquid carry over from the first and second step baths comprises a residence time of from 10 to 50 seconds in the hydrogen peroxide impregnation bath, squeezing to a liquor retention of from 60 to 80% by weight based on the dry yarn or cloth, a residence time of from 3 to 15 seconds in the activator bath followed by squeezing or pressing to a liquor retention of generally below 75% and particularly to 55–60% by weight based on the dry yarn or cloth. Naturally, some variation from these ranges can be permitted without any marked variation in product quality occuring.

Naturally, though, it is highly desirable to construct the hydrogen peroxide bath from materials which are resistant to attack by and/or on hydrogen peroxide such as stainless steel or to line the tank with a resistant rubber or plastic lining or coating.

It will be understood, that although the invention has been described specifically with respect to the use of baths for the stage of oxidation with hydrogen peroxide and activation with the transition metal salt, where circumstances permit, either or both of these steps can be carried out employing alternative means for bringing the cloth or yarn into contact with the respective solutions. Thus, one alternative method is to spray a solution onto the cloth or yarn that is passing underneath and under such circumstances, the temperatures of the solutions employed are so selected that when the cloth or yarn and solution reach an equilibrium temperature, the temperature being within the range of 40° to 80° C. for the hydrogen peroxide stage and from ambient to 80° C. for the activation stage.

The oxidation process of the present invention is suited to treating fabric or yarn which has been impregnated with sulphur dyes in a conventional manner, i.e. impregnation with the dye in the reduced form, the impregnated cloth then being steamed to encourage the dye to penetrate within the fibres. After treatment in the process of the present invention, the yarn or cloth is then preferably passed to the customary washing and rinsing stages including the standard rinsing and soaping stages.

The invention is particularly applicable to those sulphur dyes which are difficult to oxidise and these include the sulphur red brown dyes.

Having described the invention in general terms, various embodiments thereof will be described in greater detail, by way example only.

In the Examples, and in the Comparisons, a strip of plain cotton was impregnated with a freshly prepared solution of a commercially available sulphur dye, C. I. Leuco Sulphur Red 10 available under the name SULPHOL Liquid Red-Brown QCL, at approximately ambient temperature and the cloth was squeezed to give a typical uptake of about 7% of sulphur dye, based on the weight of the dry cloth and then the impregnated cloth was steamed for 1 minute. The dye selected was typical of those sulphur dyes that are difficult to oxidise. The cloth was then subjected to oxidation processes as summarised in the Table below, then rinsed with water, rinsed cold water and then dried. The resultant dyed cloth was then tested for shade change after oxidation and after washing under the conditions of ISO test No. 4. In this latter test, not only is the shade change on washing assessed but the effect of staining of white cotton and viscose cloths, i.e. redeposition of the dye, is also assessed. The shade changes and staining were assessed in a standard colour matching cabinet under standard artificial daylight illumination. By reference to standard gray scale the visual assessment was judged by two observers, whose combined views are shown herein.

The standard, against which the hydrogen peroxide oxidations were judged, was carried out using the same dyed cloth and a one step method as described for the first step of hydrogen peroxide treatment, but employing a solution of 5 g per liter of potassium dichromate and 5 g per liter of acetic acid, which solution was contacted with the sulphur dye-impregnated cloth for a period of 45 seconds at a temperature of 60° C. Such a process is representative of dichromate oxidation of sulphur dyes. The shade change and washing tests were carried out using the standard in exactly the same manner as for the hydrogen peroxide oxidations.

In the following Table, the concentration of hydrogen peroxide devoted therein by peroxide acid is given as ml of 35% by weight hydrogen peroxide solution per liter of impregnation bath solution. In Examples 6 to 15, the activator was ferric sulphate and in Examples 16 to 18, the activator was ferrous sulphate. The key to the comments column on the Table showing comments on the washing tasks is as follows:

A = Similar to dichromate standard in all the washing tests

B = Slightly worse staining of cotton but otherwise similar to dichromate standard C = Significant staining of cotton but similar to dichromate standard for shade change on washing and non-staining of viscose V = Significant staining of viscose and cotton but similar to dichromate standard for shade change on washing S = Significant colour change on washing but similar to dichromate standard for non-staining of cotton and viscose.

Comparisons are denoted by the prefix C, and in comparisons C4 and C5, the component in the second step was hydrogen peroxide and not activator. Concentration of activator was measured in g/l.

TABLE

| Ex./ Comp. No. | Step 1 Per-Oxide Conc. | Resid. Time (sec) | Temp. °C. | Step 2 Per-Oxide Conc. | Acti-vator Conc. | Resid. Time (sec) | Temp. °C. | Com-ment |
|---|---|---|---|---|---|---|---|---|
| C1 | 10 | 45 | 60 | — | — | — | — | V |
| C2 | 20 | 45 | 60 | — | — | — | — | V |
| C3 | 10 | 90 | 60 | — | — | — | — | V |
| C4 | 10 | 45 | 60 | 5 | — | 45 | 40 | V |
| C5 | 10 | 45 | 60 | 10 | — | 45 | 60 | V |
| 6 | 10 | 45 | 60 | — | 0.005 | 45 | 60 | C |
| 7 | 10 | 45 | 60 | — | 0.05 | 45 | 60 | B |
| 8 | 10 | 45 | 60 | — | 0.5 | 45 | 60 | A |
| 9 | 10 | 45 | 60 | — | 1 | 45 | 60 | A |
| 10 | 10 | 45 | 60 | — | 2 | 45 | 60 | A |
| 11 | 10 | 45 | 60 | — | 5 | 45 | 60 | S |
| 12 | 10 | 45 | 60 | — | 1 | 5 | 60 | A |
| 13 | 10 | 5 | 60 | — | 1 | 45 | 60 | A |
| 14 | 10 | 15 | 60 | — | 1 | 15 | 60 | A |
| 15 | 10 | 5 | 60 | — | 1 | 5 | 60 | A |
| 16 | 10 | 45 | 60 | — | 0.01 | 45 | 60 | B |
| 17 | 10 | 45 | 60 | — | 0.5 | 45 | 60 | S |
| 18 | 10 | 45 | 60 | — | 0.75 | 45 | 60 | A |
| 19 | 10 | 45 | 60 | — | 0.75 | 5 | 60 | A |

Similar results are obtained to those in Examples 6 to 15 and 19 by employing other water soluble ferric salts, such as ferric chloride and similar results to Examples 16 to 18 are obtained by employing other soluble ferrous salts such as ferrous chloride. Similar results to that of Example 19 were obtained when the pH of the peroxide solution was adjusted to pH2, 4 or 5 in the first step and also when the pH of the activator solution was adjusted to pH 2 or 3 in the second step.

From the Table, it can be seen that hydrogen peroxide by itself produced unsatisfactory oxidation, even when employed in a two stage process, the principle disadvantages being that the sulphur dyes were readily redeposited on other materials in the wash. The general impression gained also was that a process using hydrogen peroxide by itself required close control to obtain reproduceable results. On the contrary, when a second stage was added employing a small concentration of an activator, the problems exhibited by hydrogen peroxide were at worst significantly reduced and in the more preferred embodiments, a product having substantially the same colourfastness and non-staining characteristics as produced by the standard dichromate oxidation was obtained. The colour change in Examples 11 and 17 is believed due to the deposition of an iron compound that had been deposited on the fabric and was being removed during the washing and not due to removal of the dye itself.

I claim:

1. A process for the oxidation of sulphur dyes in reduced form, impregnated in or on a natural or regenerated cellulose fibre, comprising a first step of contacting the impregnated fibre with a dilute aqueous solution of hydrogen peroxide in order to effect at least partial oxidation of the sulphur dye and thereafter in a second step contacting the fibre containing a residual amount of the aqueous hydrogen peroxide solution with a solution of a transition metal activator for hydrogen peroxide.

2. A process according to claim 1 wherein the first step is effected at 40° to 80° C.

3. A process according to claim 1 wherein the residence time of fibre in contact with the hydrogen peroxide solution is from 3 to 60 seconds in the first step.

4. A process according to claim 1 wherein the hydrogen peroxide concentration is from 0.1 to 0.5% by weight in solution in the first step.

5. A process according to any preceding claim wherein the hydrogen peroxide solution in the first step is maintained at a pH of from 3 to 5.

6. A process according to claim 1 wherein the hydrogen peroxide solution is maintained at a concentration of 0.1 to 0.5% by weight and at a pH of 3 to 5, and is contacted with the fibre on a residence time of 3 to 60 seconds at a temperature of 40° to 80° C. in the first step.

7. A process according to claim 1 wherein the activator used in the second step is iron.

8. A process according to claim 1 wherein the concentration of activator calculated as the metal in the second step is from 0.05 to 2 g/l.

9. A process according to claim 1, 7 or 8, wherein the activator solution in the second step has a pH of from pH 3 to 4.

10. A process according to claim 1 wherein the second step is effected at a temperature of from 40° to 80° C.

11. A process according to claim 1 wherein the residence time of fibre in a bath of activator solution in the second step is from 3 to 20 seconds.

12. A process according to claim 1 or 6 wherein the activator solution in the second step contains from 0.05 to 2 g/l iron, calculated as the metal, has a pH of 3 to 4 and is contacted with the fibre at a temperature of 40° to 80° C. for a residence time of 3 to 20 seconds.

* * * * *